US006338819B1

(12) United States Patent
Braga et al.

(10) Patent No.: US 6,338,819 B1
(45) Date of Patent: Jan. 15, 2002

(54) COMBINATIONS OF IMIDAZOLINES AND WETTING AGENTS AS ENVIRONMENTALLY ACCEPTABLE CORROSION INHIBITORS

(75) Inventors: Thomas G. Braga, St. Louis, MO (US); Richard L. Martin, Sugar Land, TX (US); Jo Ann McMahon, Arnold, MO (US); Bernardus A. Oude Alink, Sugar Land; Benjie T. Outlaw, Rosenberg, both of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/250,595

(22) Filed: Feb. 16, 1999

(51) Int. Cl.[7] ..... C23F 11/14
(52) U.S. Cl. ..... 422/16; 422/6; 252/392
(58) Field of Search ..... 422/6, 16; 252/392

(56) References Cited

U.S. PATENT DOCUMENTS 3,635,826 A 1/1972 Hamilton
4,339,349 A 7/1982 Martin et al.
5,380,466 A 1/1995 Martin et al.
5,393,464 A 2/1995 Martin et al.
5,854,180 A * 12/1998 Scherubel et al. ..... 507/203

* cited by examiner

*Primary Examiner*—Elizabeth McKane
(74) *Attorney, Agent, or Firm*—Madan Mossman & Sriram P.C.

(57) ABSTRACT

A method and corrosion inhibitor for inhibiting corrosion of metal equipment in an aqueous medium comprising components selected from the group consisting of *Skeletonema costatum,* fish, other algae, and a combination thereof. The method comprises incorporating into the medium a corrosion inhibiting amount of a water soluble corrosion inhibitor comprising an N-ethoxy, 2-substituted imidazoline. The N-ethoxy substituent comprises a quantity of ethylene oxide effective to render the imidazoline water soluble. The corrosion inhibitor is rendered more environmentally compatible by shortening the number of carbon atoms in the fatty acid chain at the 2-position of the imidazoline. The fatty acid chain consists essentially about 18 carbon atoms or less, preferably about 10 carbon atoms or less, most preferably from about 6 to about 8 carbon atoms. As the number of carbon atoms in the fatty acid chain is reduced, the efficacy of the corrosion inhibitor is increased by combination with a wetting agent, preferably an ethoxylated alcohol having from about 8 to about 10 carbon atoms.

14 Claims, No Drawings

COMBINATIONS OF IMIDAZOLINES AND WETTING AGENTS AS ENVIRONMENTALLY ACCEPTABLE CORROSION INHIBITORS

FIELD OF THE INVENTION

The present invention relates to corrosion inhibition, and more particularly to inhibition of corrosion in environmentally sensitive aqueous media.

BACKGROUND OF THE INVENTION

Corrosion of metal surfaces in aqueous media, such as sea water, is a longstanding problem. The problem is especially troublesome in deep sea operations, such as offshore drilling and production, where conditions are particularly rigorous. Corrosion inhibitors for use in offshore operations must be effective under demanding deep sea conditions, and also must be environmentally acceptable. The corrosion inhibitors must meet stringent standard toxicity requirements, and also should be compatible with the sensitive life forms that are indigenous to the area. For example, in North Sea operations, the corrosion inhibitor should be compatible not only with fish, but also with indigenous algae, such as *Skeletonema costatum.*

Commonly used inhibitors have proven to be too toxic for compatibility with *Skeletonema costatum*. Even a concentration of less than one part per million by weight (ppm) of conventional inhibitors has been found to retard growth of *Skeletonema costatum* test populations by 50% in 96 hours ($EC_{50}$<1 ppm). Corrosion inhibitors are needed which have an $EC_{50}$>1 ppm for *Skeletonema costatum.*

The corrosion inhibitor also should be sufficiently biodegradable that, within 28 days after treatment, the inhibitor degrades at least 60%, most preferably 100% in terms of the theoretical oxygen consumption required for complete degradation (i.e., the biochemical oxygen demand BOD–28≧60%, preferably=100%). The inhibitor also should be sufficiently water soluble to avoid or minimize bioaccumulation in fat in lower life forms. Fat soluble inhibitors tend to become more concentrated as they move up the food chain.

Imidazolines have promise as corrosion inhibitors from an environmental standpoint because imidazolines are effective as corrosion inhibitors even though they do not contain sulfur or phosphorus. However, imidazoline inhibitors are needed which are both effective as corrosion inhibitors and which also meet stringent toxicity standards, such as an $EC_{50}$>1 ppm for *Skeletonema costatum.*

SUMMARY OF THE INVENTION

The present invention provides a method of inhibiting corrosion of metal equipment in an aqueous medium comprising components selected from the group consisting of *Skeletonema costatum*, fish, other algae, and a combination thereof, said method comprising incorporating into the aqueous medium an amount of a water soluble corrosion inhibitor effective to inhibit said corrosion. The corrosion inhibitor comprises an N-ethoxy, 2-substituted imidazoline. The N-ethoxy substituent comprises a quantity of ethylene oxide effective to render the imidazoline water soluble. The 2-substituent comprises a fatty acid chain consisting essentially of 18 carbon atoms or less.

DETAILED DESCRIPTION OF THE INVENTION

The present invention provides imidazolines with reduced toxicity which are effective to inhibit the corrosion of metal equipment in an aqueous environment. Toxicity is minimized by reducing the chain length of the acid used to make the imidazoline. Imidazolines with shorter chain lengths tend to be less effective as corrosion inhibitors; however, the addition of certain wetting agents has been found to increase the effectiveness of these less toxic imidazolines as corrosion inhibitors.

Preferred corrosion inhibitors do not contain sulfur or phosphorus and are "environmentally compatible." As used herein, the term environmentally compatible shall mean that a substance has little or no deleterious environmental effects on a medium of concern, and includes, but is not necessarily limited to considerations such as toxicity, water-solubility, biodegradability, and so forth. Although the term "non-toxic" is used herein, nearly every substance is toxic at some concentration. The term "non-toxicity" refers to very low toxicity at the relevant concentration. For example, for offshore drilling and production, the term "non-toxicity" or "non-toxic" refers to compositions having and $EC_{50}$ greater than 1 ppm by weight for *Skeletonema costatum.*

Suitable imidazolines for use as corrosion inhibitors include, but are not necessarily limited to N-ethoxy, 2-substituted imidazolines, the N-ethoxy substituent comprising an amount of ethylene oxide effective to render said imidazoline water soluble, preferably from about 3 to about 9 moles of ethylene oxide, and the 2-substituent comprising an unsaturated or polyunsaturated fatty chain comprising less than about 18 carbon atoms, preferably less than about 10 carbon atoms, more preferably less than about 8 carbon atoms. Preferably, the fatty chain has at least 6 carbon atoms, most preferably from about 6 to about 8 carbon atoms.

The foregoing imidazolines are prepared by reacting a starting amine, preferably an N-substituted amine, most preferably 2,2-aminoethylamino ethanol (AEEA) or a diethylene tetramine (DETA), with a fatty acid to form an imidazoline. A most preferred starting amine is an N-substituted ethylene diamine having the formula $H_2NCH_2CH_2NHRMH$, wherein R is an organic moiety and —MH is a terminal group comprising a hetero atom such as oxygen, nitrogen or sulfur, preferably oxygen or nitrogen, and at least one hydrogen, providing a site for attachment of ethylene oxide. Although R may include nitrogen atoms, it is preferred for R to be an alkylene, an arylene, or an aralkylene. Of these, preferred R groups are ethylene, isopropylene and $—(CH_2CH_2O)_n(CH_2CH_2)—$, wherein n is an integer from about 1 to about 30. Out of these possibilities, preferred R groups are ethylene and the group $—(CH_2CH_2O)_n(CH_2CH_2)—$ wherein n is an integer from about 1 to about 17. Most preferably, R is ethylene.

The group MH provides a site for attachment of ethylene oxide for ether or polyether formation. Preferably, MH is selected from the group consisting of —OH, $—NH_2$, or —SH, with SH being least preferred and —OH being most preferred. Specific, preferred N-substituted ethylene diamines include, for example, $NH_2CH_2CH_2NH—CH_2CH_2(CH_3)OH$; $NH_2CH_2CH_2NH—CH_2CH_2NH_2$; and, most preferably, $NH_2CH_2CH_2NH—CH_2CH_2OH$.

The starting amine and the fatty acid are reacted in about a 1:1 molar ratio under a vacuum with the addition of heat, such as up to about 240° C., until all water is removed. The resulting imidazoline is then ethoxylated to build the N-substituent of the imidazoline to include a total of 3–9 moles of ethylene oxide, as necessary, to render the product water-soluble. As used herein, the term water-soluble means miscible with water at the concentration to be employed for corrosion inhibition. The resulting product has the following structure:

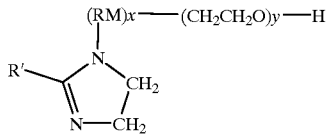

wherein R and R' (the residue of the fatty acid) are alkyl groups comprising from about 6 to about 28 carbon atoms; M is t he residue from the —MH group after removal of the R, preferably —O—, —NH—, or —S—, most preferably —O—; x (the number of —RM groups) is 0 or 1 and y is an integer from 0 to about 28 selected so that the total number of ethoxy units in the N-substituent is from about 1 to about 28, preferably from about 3 to about 9).

In order to be effective, the corrosion inhibitor preferably inhibits corrosion to about 50 mils per year (mpy) or less, as measured by green kettle testing. Imidazolines having 8 or fewer carbon atoms may be effective when used alone as corrosion inhibitors, but are more effective and preferably are used in combination with a wetting agent. Suitable wetting agents include, but are not necessarily limited to oxyalkylated alcohols having from 6 to about 32 carbon atoms, preferably from about 8 to about 10 carbon atoms. Oxyalkylation, preferably ethoxylation, makes the alcohol more water-soluble. Each carbon atom of the alcohol preferably should have at least one hydrogen to provide superior biodegradability. Alfol 8–10 (a mixture of C8 to C10 alcohols), which is available from a variety of sources, is especially suitable.

The alcohol may be ethoxylated using standard techniques. For example, the alcohol may be heated with a base or amine catalyst to a temperature of from about 100° C. to about 150° C., depending upon the catalyst, and ethylene oxide may be added thereto. The resulting ethoxylated alcohol has the structure $R^1O—(CH_2CH_2O)_zH$, wherein $R^1$ is a substituted or unsubstituted alkyl, aryl, or aralkyl group of from about 6 to about 32, preferably from about 8 to about 10 carbon atoms. $R^1$ preferably is an alkyl group, most preferably an unsubstituted alkyl group. The relative proportion of ethylene oxide to alcohol depends on the degree of ethoxylation desired to provide sufficient water-solubility and biodegradability. Generally, the heavier the alcohol, the greater the degree of ethoxylation that is feasible. Although any degree of ethoxylation is feasible, economic practicalities suggest that it is not desirable to add more than about ten moles of ethylene oxide per mole of alcohol. Therefore, z preferably is an integer from about 1 to about 10, more preferably from about 2 to about 5, and most preferably from about 2 to about 3.

The corrosion inhibitor also may comprise a solvent, preferably an environmentally compatible solvent such as water, ethylene glycol, or propylene glycol. The blends have been found generally to be water-soluble; however some compositions with a low degree of ethoxylation are merely water-dispersible. In such cases, the use of isopropyl alcohol may clarify the solution, however the use of isopropyl alcohol is discouraged due to its lack of environmental compatibility. If no other components are present, the weight ratio of corrosion inhibitor to solvent is from about 2:1 to about 1:2, preferably about 1:1.

The effective composition of inhibitor actives (that is, the concentration at which corrosion inhibition is provided) is in the range of from about 1 to about 1000 ppm, preferably from about 5 to about 250 ppm, most preferably about 250 ppm. Rapid dilution of the inhibitor occurs quickly, e.g, in overboard brine from off-shore oil production.

The invention will be better understood with reference to the following examples, which are illustrative only, and should not be construed as limiting the invention to any particular embodiment.

EXAMPLE I

Kettle tests were performed to compare the corrosion rate of imidazolines made from either DETA ("D") or AEEA ("A") using a variety of fatty acids, at a variety of levels of ethoxylation, some with, and some without salting with acetic acid.

For the kettle tests, various amounts of inhibitors were added to aqueous solutions of 3% sodium chloride, which were then stirred mildly under the following conditions:

| | |
|---|---|
| Temperature | 60° C. |
| Gas | High purity $CO_2$ at one atmosphere |
| Brine Composition: | Chevron Ninian North Brine (see below) |
| Hydrocarbon Phase: | ISOPAR M* |
| pH Control: | Measured at start and finish of test |
| Brine/hydrocarbon volumes: | 800 mls/100 mls |
| Inhibitor Dosage: | 100 ppm |
| Test Duration: | 22 hours |
| Precorrosion Time: | 1 hour |
| Electrodes: | Standard 9 $cm^2$ linear polarization resistance corrosion rate type |
| Agitation: | 150 rpm stirring |
| Monitoring Method: | Linear polarization/Tafel plots |
| Tafel Constants: | 165 mV/decade |
| Measurement Frequency: | Every 30 minutes |

*An aliphatic hydrocarbon available from a variety of sources.

Chevron Ninian North Brine has the following composition:

| | |
|---|---|
| $HCO_3^-$: | 570 mg/l |
| $SO_4^{2-}$: | 2,098 mg/l |
| $K^+$: | 337 mg/l |
| $Cl^-$: | 18,673 mg/l |
| $Ca^{2+}$: | 508 mg/l |
| $Mg^{2+}$: | 919 mg/l |
| $Sr^{2+}$: | 21 mg/l |

"Sweet" test solutions were sparged continuously with carbon dioxide. "Sour" test solutions were sparged with carbon dioxide and then enough $Na_2S.H_2O$ was added to give a hydrogen sulfide concentration of 0 ppm and a pH of 5.5. The sour solutions were then sealed. AISI-1020 coupons were weighed, added to the solutions before stirring, removed from the solutions at the completion of the stirring, cleaned, and reweighed. Corrosion rates were calculated based on the weight loss of the AISI-1020 coupons. The results are shown in Table 1, with the inhibitor concentration (dose) being given in ppm, the corrosion rates being given in mils per year (mpy) and many of the results being averages of duplicate runs:

TABLE 1

| # | IMID TYPE | FATTY ACID CHAIN LENGTH | ETHOX. | ACID SALT | FINAL CORROSION RATE, MPY |
|---|---|---|---|---|---|
| 1 | D | 22 | 12 | N | 84 |
| 2 | A | 6 | 6 | Y | 280 |
| 3 | D | 12 | 3 | Y | 18.1 |
| 4 | A | 6 | 3 | N | 305 |
| 5 | D | 6 | 3 | Y | 310 |
| 6 | A | 6 | 12 | N | 259 |

TABLE 1-continued

| # | IMID TYPE | FATTY ACID CHAIN LENGTH | ETHOX. | ACID SALT | FINAL CORROSION RATE, MPY |
|---|---|---|---|---|---|
| 7 | A | 22 | 3 | N | 43 |
| 8 | D | 22 | 12 | Y | 137 |
| 9 | A | 6 | 3 | Y | 300 |
| 10 | A | 12 | 12 | Y | 258 |
| 11 | D | 22 | 3 | N | 8 |
| 12 | D | 6 | 12 | Y | 304 |
| 13 | D | 6 | 3 | N | 279 |
| 14 | D | 22 | 6 | Y | |
| 15 | A | 12 | 6 | N | 195 |
| 16 | A | 22 | 3 | Y | 14.5 |
| 17 | D | 6 | 6 | N | 286 |
| 18 | D | 12 | 12 | N | 34 |
| 19 | A | 22 | 12 | N | 273 |
| 20 | A | 22 | 12 | Y | |
| 21 | A | 6 | 9 | N | 267 |
| 22 | A | 12 | 3 | N | 55 |
| 23 | D | 6 | 12 | N | 271 |
| 24 | D | 12 | 6 | N | 12 |
| 25 | D | 10 | 12 | N | 269 |
| 26 | A | 10 | 9 | N | 254 |
| 27 | D | 18 | 6 | N | 12 |
| 28 | D | 18 | 9 | N | 25 |
| 29 | D | 12 | 3 | N | 9 |
| 30 | D | 22 | 12 | N | 202 |

The foregoing data were analyzed using a multiple regression model. The original model was a complete quadratic of the following terms: imidazoline type, fatty acid length, ethoxylation and acid salt. From the analysis, it was concluded that the effect of the imidazoline series on the corrosion rate was dependent on the type of imidazoline, the fatty acid chain length and the extent of ethoxylation. Generally, the larger the fatty acid chain length, the better the corrosion protection up to C=18. For C>18 the corrosion protection began to drop. Generally, the lower the extent of ethoxylation, the better the corrosion protection. The effect of ethoxylation on corrosion protection was more apparent for the higher fatty acid chain lengths. There was no statistically significant evidence that the corrosion inhibition of the imidazoline series was dependent on the formation of an acid salt.

EXAMPLE II

The corrosion inhibitors in Table I were analyzed using the same procedures to determine the impact of the presence and absence of a surfactant. The samples with added surfactant contained 1–10 wt % of M-131 (a mixture of ethoxylated alcohols comprising 8–10 carbon atoms which is available from a variety of commercial sources). The results are shown in Tables 2 and 3:

TABLE 2

| # | IMID. TYPE | FATTY ACID (C #) | ETHOX. (E #) | SURF | CORROSION RATE (MPY) |
|---|---|---|---|---|---|
| 1 | A | 6.0 | 0.0 | n | 18 |
| 2 | A | 6.0 | 6.0 | n | 10 |
| 3 | A | 6.0 | 9.0 | n | 7 |
| 4 | A | 6.0 | 12.0 | n | 11 |
| 5 | A | 10.0 | 3.0 | n | 2 |
| 6 | A | 10.0 | 6.0 | n | 3 |
| 7 | A | 10.0 | 9.0 | n | 11 |
| 8 | A | 10.0 | 12.0 | n | 23 |
| 9 | A | 12.0 | 3.0 | n | 2 |
| 10 | A | 12.0 | 6.0 | n | 33 |

TABLE 2-continued

| # | IMID. TYPE | FATTY ACID (C #) | ETHOX. (E #) | SURF | CORROSION RATE (MPY) |
|---|---|---|---|---|---|
| 11 | A | 12.0 | 9.0 | n | 19 |
| 12 | A | 12.0 | 12.0 | n | 10 |
| 13 | A | 18.0 | 3.0 | n | 12 |
| 14 | A | 18.0 | 9.0 | n | 7 |
| 15 | A | 18.0 | 12.0 | n | 11 |
| 16 | D | 6.0 | 3.0 | n | 23 |
| 17 | D | 6.0 | 12.0 | n | 18 |
| 18 | D | 10.0 | 3.0 | n | 4 |
| 19 | D | 10.0 | 6.0 | n | 6 |
| 20 | D | 10.0 | 9.0 | n | 6 |
| 21 | D | 10.0 | 12.0 | n | 5 |
| 22 | D | 12.0 | 3.0 | n | 2 |
| 23 | D | 12.0 | 6.0 | n | 6 |
| 24 | D | 12.0 | 9.0 | n | 8 |
| 25 | D | 12.0 | 12.0 | n | 5 |
| 26 | D | 18.0 | 3.0 | n | 4 |
| 27 | D | 18.0 | 6.0 | n | 2 |
| 28 | D | 18.0 | 6.0 | n | 2 |
| 29 | D | 18.0 | 9.0 | n | 4 |
| 30 | D | 18.0 | 12.0 | n | 2 |
| 31 | D | 22.0 | 3.0 | n | 9 |
| 32 | D | 22.0 | 2.0 | n | 10 |

TABLE 3

| | Imid. type | Fatty acid (C #) | Ethoxylation (E #) | Surfactant | Corrosion rate (MPY) |
|---|---|---|---|---|---|
| 1 | A | 6.0 | 0.0 | y | 4 |
| 2 | A | 10.0 | 0.0 | y | 4 |
| 3 | A | 12.0 | 0.0 | y | 6 |
| 4 | A | 18.0 | 0.0 | y | 2 |
| 5 | A | 18.0 | 0.0 | y | 2 |
| 6 | A | 22.0 | 0.0 | y | 3 |
| 7 | A | 22.0 | 0.0 | y | 4 |
| 8 | A | 6.0 | 3.0 | y | 14 |
| 9 | A | 6.0 | 3.0 | y | 15 |
| 10 | A | 6.0 | 3.0 | y | 3 |
| 11 | A | 6.0 | 6.0 | y | 4 |
| 12 | A | 6.0 | 9.0 | y | 4 |
| 13 | A | 6.0 | 12.0 | y | 12 |
| 14 | A | 18.0 | 3.0 | y | 2 |
| 15 | A | 18.0 | 3.0 | y | 2 |
| 16 | A | 18.0 | 6.0 | y | 2 |
| 17 | A | 18.0 | 9.0 | y | 0.6 |
| 18 | A | 18.0 | 12.0 | y | 11 |
| 19 | A | 22.0 | 3.0 | y | 13 |
| 20 | A | 22.0 | 12.0 | y | 22 |
| 21 | D | 18.0 | 3.0 | y | 3 |
| 22 | D | 18.0 | 9.0 | y | 7 |
| 23 | D | 22.0 | 12.0 | y | 7 |

The foregoing data was subjected to multiple regression analysis. The models investigated did not give very good fits. Therefore, the following conclusions should be viewed with caution.

Both with and without surfactant, the fatty acid chain length showed a significant effect. Although the D-imidazoline performed equal to or better then the A-imidazoline in the absence of surfactant, the effect of the imidazoline type was removed with the addition of surfactant. For both imidazoline types with and without surfactant, the best performance was seen in the C-10 to C-18 range. Generally, the addition of the surfactant increased the corrosion protection.

EXAMPLE IV

Toxicity testing was performed using standard procedures. For statistical treatment of the range information, the design was doubled and both the minimum and maximum values where included as separate entries. The results are given in Table 4:

TABLE 4

| | Imid. Type | Fatty Acid (chain length) | EtO Level | Acid Salt | SKELETONEMA $EC_{50}$ RANGE (mg/l) |
|---|---|---|---|---|---|
| 1# | D | C22 | E12 | | 0.5–5 |
| 2 | A | C6 | E6 | /A | 10–25 |
| 3 | D | C12 | E3 | /A | 0.1–1 |
| 4 | A | C6 | E3 | | 10–25 |
| 5 | D | C6 | E3 | /A | 25–100 |
| 6 | A | C6 | E12 | | 25–100 |
| 7* | A | C22 | E3 | | |
| 8# | D | C22 | E12 | /A | 0.5–1 |
| 9 | A | C6 | E3 | /A | 10–25 |
| 10 | A | C12 | E12 | /A | 1–5 |
| 11** | D | C22 | E3 | | |
| 12 | D | C6 | E12 | /A | 25–100 |
| 13 | D | C6 | E3 | | >25 |
| 14# | D | C22 | E6 | /A | 0.1–1 |
| 15 | A | C12 | E6 | | 0.5–1 |
| 16# | A | C22 | E3 | /A | 0.1–0.5 |
| 17 | D | C6 | E6 | | >25 |
| 18 | D | C12 | E12 | | 0.1–0.5 |
| 19# | A | C22 | E12 | | 0.1–0.5 |
| 20# | A | C22 | E12 | /A | 0.1–0.5 |

*Sample not available.
**Water soluble fraction.
#Sample heated.

Analysis of the above data was performed using a multiple regression model. The original model was a complete quadratic of the following terms: imidazoline type, fatty acid length, ethoxylation and acid salt. Based on the analysis, it was concluded that the $EC_{50}$ of the imidazoline series is dependent on the fatty acid chain length and the extent of ethoxylation. Generally, (a) the smaller the fatty acid chain length, the lower the toxicity, and (b) the larger the extent of ethoxylation, the lower the toxicity. There was no statistically significant evidence that the $EC_{50}$ of the imidazoline series was dependent on the imidazoline type or the formation of an acid salt.

EXAMPLE V

The procedures of Example I were repeated using imidazolines derived from AEEA. A few tests were modified to include 0.8% $CaCl_2$, a few with 200 cc (2000 cc total) of ISOPAR, a few heated to 60° C. for comparison with tests performed at 23° C., a few with 0.3% NaCl or 15% NaCl, and a few were monitored via recording linear polarization resistance corrosion rate instrumentation, as indicated below.

Several results were replicated. The replications confirm that sweet kettle tests give better repeatability than sour ($H_2S$) tests, probably due to the cleaning difficulty of sulfide films on the electrodes. Sour conditions also usually are easier to inhibit than sweet ($CO_2$ only).

The results of the corrosion tests are reflected in Table 5, in which the following have the following meanings: "A" refers to an AEEA derived imidazoline; "D" refers to a DETA derived imidazoline; "C" refers to carbon atoms; the number after the "C" indicates the number of carbon atoms; "E" refers to ethoxy units; the number before the "E" indicates the number of ethoxy units; KW-2103 is a quaternary ammonium compound which is commercially available from Baker Petrolite; IPA refers to isopropyl alcohol; TENAX 2010™ salt is an adduct of maleic anhydride and tolyl fatty acid, which is available from West Vaco; "OE" refers to zero ethoxy units; OEA refers to zero ethoxy units with acid.

TABLE 5

Hot and Hydrocarbon Series

| Compound | Conditions | Sweet mpy |
|---|---|---|
| AC10-3E, $H_2O$ | Regular (23° C.) | 1.7 |
| AC18-6E, $H_2O$, M-131, IPA | Regular (23° C.) | 1.7 |
| AC10-3E, $H_2O$ | 200 cc ISOPAR (23° C.) | 0.4 |
| AC18-6E, $H_2O$, M-131, IPA | 200 cc ISOPAR (23° C.) | 1.0 |
| KW-2103 | Regular (60° C.) | 10.3, 6.4 |
| KW-2103 | 200 cc ISOPAR (60° C.) | 0.7 (stir some off) |
| None | 60° C. | 77 |
| AC10-3E, $H_2O$ | 60° C. | 5.7 |
| KW-2103 | 60° C. | 18 |

All of the samples exhibited less corrosion than the blank The samples containing imidazolines exhibited less corrosion than those containing quaternary ammonium compounds, except sample AC10-3E, $H_2O$. The performance of this sample probably was poorer because the imidazoline contained only 10 carbon atoms, no wetting agent was added, and the sample also was heated to 60° C.

EXAMPLE VI

A series of tests were performed under the conditions of Example I at 23° C., varying chain length of the fatty acid moiety, using a water solution, adding xylene M-131, and/or IPA or methanol. The results are given in Table 6:

TABLE 6

Imidazoline Series

| Compound | mpy Sweet |
|---|---|
| AC6-OE, xylene, M-131, IPA | 3.7 |
| AC10-OE, xylene, M-131, IPA | 4.3 |
| AC12-OE, xylene, M-131, IPA | 5.9 |
| AC18-OE, xylene, M-131, IPA | 2.2, 2.0 |
| AC22-OE, xylene, M-131, IPA | 3.4, 3.9 |
| AC6-3E, xylene, M-131, IPA | 14, 15 |
| AC6-3E, $H_2O$, M-131,IPA | 2.7 |
| AC6-6E, $H_2O$, M-131, IPA | 3.9 |
| AC6-9, $H_2O$, M-131,IPA | 4.2 |
| AC6-12, $H_2O$, M-131, IPA | 11.6 |
| AC6-OE, $H_2O$ | 18 |
| AC6-3E, $H_2O$ | 6.9 |
| AC6-6E, $H_2O$ | 9.6 |
| AC6-9E, $H_2O$ | 7.2 |
| AC6-12E, $H_2O$ | 10.5 |
| AC6-12E, MeOH | 3.5 |
| AC10-3E, $H_2O$ | 1.7 |
| AC10-6E, $H_2O$ | 3.2 |
| AC10-9E, $H_2O$ | 10.5 |
| AC10-12E,$H_2O$ | 23 |
| AC12-3E, $H_2O$ | 1.7 |
| AC12-6E, $H_2O$ | 33 |
| AC12-9E, $H_2O$ | 19 |
| AC12-12E, $H_2O$ | 10.4 |
| AC18-E3, $H_2O$ | 12 |
| AC18-6E, $H_2O$ | 2.2 |
| AC18-9E, $H_2O$ | 6.6 |
| AC18-12E, $H_2O$ | 10.7 |
| AC18-E3, $H_2O$, M-131, IPA | 1.9, 2.4 |
| AC18-6E, $H_2O$, M-131, IPA | 1.7 |
| AC18-9E, $H_2O$, M-131, IPA | 0.6 |
| AC18-12E, $H_2O$, M-131, IPA | 10.7 |
| AC22-E3, xylene, M-131, IPA | 12.5 |
| AC22-12E, xylene, M-131, IPA | 19 |
| AC22-12E, $H_2O$, M-131, IPA | 22 |

From the foregoing data, it was concluded that several of the imidazolines can be formulated to give better performance than KW-2103 and KW 2590, both of which are corrosion inhibitors without phosphate, which are available from Baker Petrolite. When dispersed by an oxyalkylated alcohol, solutions of the starting imidazolines all gave fair results, the C18 being the best. Water dissolved all of the oxyalkylates except the C22 series. Methanol dissolved all of the oxyalkylates, but the C22 series were stiff at room temperature. Using a xylene solvent was inferior to water for low end oxyalkylates, but made no difference at the high end. Based on one test, methanol made a difference. Inhibitors which had too great or too little solubility were less effective than the optimum for each brine type. Effective solubility was the combination of the imidazoline itself and the blended wetting agent. The optimum effectiveness varied depending on the brine concentration.

Of the routes to achieve optimum corrosion performance, previous experience suggested that greener properties would result from the higher chain length/higher oxide combinations than from shorter chain lengthless oxide. In some cases, reaction with $P_2O_5$ produced a product which was better than the starting imidazoline. Without dispersant, sulfur, or phosphate, an acid chain length of 10 was the lowest for good corrosion control. The toxicity data suggested that the lower the acid chain length, the better the $LD_{50}$ numbers. Since corrosion results suggested that a medium acid chain length was best and toxicity results suggested that a short acid chain length was best, it was decided that chain lengths somewhere intermediate the two would be advantageous.

In these sweet systems, integrated linear polarization resistance corrosion rate readings averaged about twice weight loss rates in inhibited tests, about three times the weight loss in blank tests. This was in agreement with experience; the beta slopes assumed by linear polarization resistance corrosion rate instrumentation are right for sour systems but are not correct for sweet systems.

EXAMPLE VII

The procedures of Example I were repeated at 23° C. using the imidazoline series shown in Table 7 to give the results shown:

TABLE 7

| Imidazoline Series | Sweet | | | | |
|---|---|---|---|---|---|
| Inhibitor | 25 ppm | 50 ppm | 250 ppm | Equivalent "A" @ 250 ppm | Sour 250 ppm |
| DC6 E3, $H_2O$ | | | 23 | 6.9 | |
| DC6 E3/A, $H_2O$ | | | 20 | | |
| DC6 E12, $H_2O$ | | | 18 | 11 | |
| DC6 E12, MeOH | | | 13, 5.0 | 3.5 | |
| DC6 E12, IPA | | | 14 | | |
| DC6 E12 (no solvent) | | | 19 | | |
| DC10 E3, $H_2O$ | 2.4 | 2.0 | 3.7 | 1.7 | 3.4 |
| DC10 E6, $H_2O$ | | | 6.0 | | |
| DC10 E9, $H_2O$ | | | 5.6 | | |
| DC10 E12, $H_2O$ | | | 4.7 | | |
| DC12 E3, $H_2O$ | | | 2.4 | 1.7 | |
| DC12 E6, $H_2O$ | | | 5.9 | 33 | |
| DC12 E9, $H_2O$ | | | 7.7 | 19 | |
| DC12 E12, $H_2O$ | | | 4.8 | 10 | |
| DC18 E3, $H_2O$ | | | 3.8 | 12 | |
| DC18 E3/A, $H_2O$ | | | 4.0 | | |
| DC18 E3, MeOH | | | 5.0 | | |
| DC18 E3, M131, $H_2O$, IPA | 3.5 | 6.8 | 3.1 | 2.1 | 1.0 |
| DC18 E3, M1660, $H_2O$ | 7.2 | 2.0 | 1.1 | | |
| DC18 E6, $H_2O$ | | | 2.1 | 2.2 | |

TABLE 7-continued

| Imidazoline Series | Sweet | | | | |
|---|---|---|---|---|---|
| Inhibitor | 25 ppm | 50 ppm | 250 ppm | Equivalent "A" @ 250 ppm | Sour 250 ppm |
| DC18 E6, $H_2O$ | 4.5 | 5.4 | 2.2 | (2.1) | 3.1 |
| DC18 E9, $H_2O$ | | | 3.8 | 6.6 | |
| DC18 E9, M131, IPA, $H_2O$ | | | 7.0 | 0.6 | |
| DC18 E11, $H_2O$ | 5.0 | 9.6 | 1.5 | 11 | 1.5 |
| DC110 E3, DCl8 E3, DC18 E12, $H_2O$ | 6.8 | 3.5 | 2.6 | | 0.6 |
| DC22 E3, $H_2O$ | | | 8.5 | | |
| DC22 E3, MeOH | | | 2.6 | | |
| DC22 E12, $H_2O$ | | | 10 | | |
| DC22 E12, M131, IPA, $H_2O$ | | | 6.6 | 22 | |
| KW2103 | 22 | 9.9 | 7.0 | | 3.9 |
| KX090 | 20 | 8.3 | 1.5 | | 0.8 |
| CRW10 | 12 | 10 | 3.0 | | 2.4 |
| RLM400* | 0.9 | 4.9 | 2.4, 7.1 | | |

*RLM400 is DC18 E12, propylene glycol, water

Tests also were performed to determine the impact of brine on DETA derived imidazolines. The results are shown in Table 8:

TABLE 8

| Brine Series | Sweet mpy @ 250 ppm | | |
|---|---|---|---|
| Inhibitor | 0.3% NaCl | 3% NaCl | 15% NaCl |
| DC10 E3, $H_2O$ | 3.9 | 3.7 | 4.6 |
| DC18 E12, $H_2O$ | 3.9 | 1.5 | 1.8 |
| DC10 E3, DC18 E3, DC18 E12, $H_2O$ | 6.5 | 2.6 | 6.5 |

Based on all of the foregoing experiments, it was concluded that the series of oxyalkylated imidazolines made with DETA showed about the same corrosion inhibition as those made with AEEA. The most effective inhibitors in the DETA series were made with C10, C12, and C18 acids. This was also the case with the AEEA series. The DETA derived imidazolines tended to be less water soluble than the AEEA derived imidazolines, although all of the oxyalkylates were soluble at use concentration. Probably as a result of this solubility tendency, the maximum inhibition in each subgroup of the DETA series was moved toward lighter acids or more ETO compared to the AEEA series.

In some cases, the addition of a wetting agent (oxyalkylated alcohol) added inherent solubility, and the addition of phosphate ester helped performance. Some of the DETA imidazolines were more inhibitive than KW-2103; the difference being even greater at lower concentrations. Many of this series had about the same activity at 25 ppm as at 50 ppm. The active concentration of the test inhibitors was usually 23–25%. These imidazolines usually gave better inhibition in sour systems than in sweet.

Inhibitors formulated with methanol solvent rather than with water were sometimes more effective. This also seemed to be the case with AEEA compounds and was a surprising result. Blends of three imidazolines which perform well separately showed no activity improvement. Acetic acid salting of the DETA imidazolines yielded no performance change. Some of these imidazolines still showed good results when formulated with propylene glycol: RLM400 is an example made with DC18E12 and no phosphate ester.

EXAMPLE VIII

The procedures of Example I were repeated at 23° with the following series of compositions (3% NaCl, $CO_2$ saturated). The results are shown in Table 9:

TABLE 9

| Imidazolines | | |
|---|---|---|
| Inhibitor | Concentration (ppm) | Sweet MPY |
| DC6E3, $H_2O$* | 250 | 23 |
| DC6E6 (neat)* | 85 | 32 |
| DC6E9 (neat)* | 85 | 42 |
| DC6E12, $H_2O$* | 250 | 18 |
| DC8E3 (neat) | 85 | 11 |
| DC8E6 (neat) | 85 | 6.1 |
| DC10E3, $H_2O$* | 250 | 3.7 |
| DC10E6, $H_2O$* | 250 | 6.0 |
| DC10E9, $H_2O$* | 250 | 5.6 |
| DC10E12, $H_2O$* | 250 | 4.7 |

The corrosion inhibition properties of the low oxyalkylate end of the $C_8$-DETA imidazolines were intermediate. The toxicity properties of the $C_8$-DETA imidazolines unfortunately were closer to the $C_{12}$ than to the $C_6$ series. (Range finding toxicity $EC_{50}$ for DC6E3 was above 25, for DC8E3 was 1–3, for DC12E3 was 0.1–1).

Many modifications and variations may be made to the embodiments described herein without departing from the spirit of the present invention. The embodiments described herein are illustrative only should not be construed as limiting the scope of the present invention.

We claim:

1. A method of inhibiting corrosion of metal equipment in an aqueous medium comprising components selected from the group consisting of *Skeletonema costatum,* fish, other algae, and a combination thereof, said method comprising incorporating into said medium an amount of a water soluble corrosion inhibitor effective to inhibit said corrosion, wherein said corrosion inhibitor comprises an N-ethoxy, 2-substituted imidazoline, said N-ethoxy substituent comprising from about 3 to about 9 moles of ethylene oxide effective to render said imidazoline water soluble, said 2-substituent comprising a fatty acid chain consisting essentially of 18 carbon atoms or less; and an ethoxylated alcohol wetting agent having from about 8 to about 10 carbon atoms.

2. The method of claim 1 wherein said fatty acid chain consists essentially of 10 carbon atoms or less.

3. The method of claim 2 wherein said corrosion inhibitor, alone, provides a first level of corrosion inhibition, and said combination of said corrosion inhibitor and said wetting agent provides a second level of corrosion inhibition which is greater than said first level.

4. The method of claim 1 wherein said corrosion inhibitor, alone, provides a first level of corrosion inhibition, and said combination of said corrosion inhibitor and said wetting agent provides a second level of corrosion inhibition which is greater than said first level.

5. The method of claim 1 wherein said amount is from about 5 to about 250 ppm.

6. A method of inhibiting corrosion of metal equipment in an aqueous medium comprising components selected from the group consisting of *Skeletonema costatum*, fish, other algae, and a combination thereof, said method comprising incorporating into said medium an amount of a water soluble corrosion inhibitor effective to inhibit said corrosion, wherein said corrosion inhibitor comprises an N-ethoxy, 2-substituted imidazoline, said N-ethoxy substituent comprising from about 3 to about 9 moles of ethylene oxide effective to render said imidazoline water soluble, said 2-substituent comprising a fatty acid chain consisting essentially of 8 carbon atoms or less; and an ethoxylated alcohol wetting agent having from about 8 to about 10 carbon atoms.

7. The method of claim 6 wherein said corrosion inhibitor, alone, provides a first level of corrosion inhibition, and said combination of said corrosion inhibitor and said wetting agent provides a second level of corrosion inhibition which is greater than said first level.

8. The method of claim 7 wherein said amount is from about 5 to about 250 ppm.

9. The method of claim 6 wherein said amount is from about 5 to about 250 ppm.

10. A method for reducing toxicity of a corrosion inhibitor comprising an N-ethoxy, 2-substituted imidazoline, said N-ethoxy substituent comprising from about 3 to about 9 moles of ethylene oxide effective to render said imidazoline water soluble, said method comprising providing as said 2-substituent a fatty acid chain consisting essentially of 18 carbon atoms or less, and providing an ethoxylated alcohol wetting agent having from about 8 to about 10 carbon atoms.

11. The method of claim 10 wherein said fatty acid chain consists essentially of about 10 carbon atoms or less.

12. The method of claim 10 wherein said fatty acid chain consists essentially of about 8 carbon atoms or less.

13. A water soluble, biodegradable corrosion inhibitor composition comprising an N-ethoxy, 2-substituted imidazoline, said N-ethoxy substituent comprising from about 3 to about 9 moles of ethylene oxide effective to render said imidazoline water soluble, wherein said 2-substituent comprises a fatty acid chain consisting essentially of 18 carbon atoms or less; and an ethoxylated alcohol wetting agent having from about 8 to about 10 carbon atoms.

14. The corrosion inhibitor of claim 13 wherein said fatty acid chain consists essentially of from about 6 to about 8 carbon atoms.

* * * * *